US006409092B1

(12) United States Patent
Demmig et al.

(10) Patent No.: US 6,409,092 B1
(45) Date of Patent: Jun. 25, 2002

(54) SUPERSTRUCTURE CONSTRUCTION

(75) Inventors: Albrecht Demmig, Kirchmoser; Hans-Ulrich Dietze, Wusterwitz; Hubertus Hohne; Sebastian Benenowski, both of Butzbach, all of (DE)

(73) Assignee: BWG Butzbacher Weichenbau GmbH & Co. KG, Butzbach (DE)

( * ) Notice: Subject to any disclaimer, the term of this patent is extended or adjusted under 35 U.S.C. 154(b) by 0 days.

(21) Appl. No.: 09/479,932

(22) Filed: Jan. 10, 2000

Related U.S. Application Data

(63) Continuation of application No. 09/051,476, filed as application No. PCT/EP96/04536 on Oct. 18, 1996, now Pat. No. 6,027,034.

(30) Foreign Application Priority Data

Oct. 20, 1995 (DE) ..... 195 39 144
Nov. 25, 1995 (DE) ..... 195 44 055

(51) Int. Cl.[7] ..... E01B 9/00
(52) U.S. Cl. ..... 238/382; 238/283
(58) Field of Search ..... 238/2, 3, 4, 5, 238/6, 7, 8, 9, 122, 125, 131, 283, 382, 349, 351

(56) References Cited

U.S. PATENT DOCUMENTS 4,771,944 A * 9/1988 Brister et al. ..... 238/283
4,775,103 A * 10/1988 Ortwein ..... 238/283
5,165,598 A * 11/1992 Ortwein ..... 238/382
5,195,679 A * 3/1993 Leeves et al. ..... 238/382
5,335,850 A * 8/1994 Igwemezie ..... 238/283
5,361,986 A * 11/1994 Meier et al. ..... 238/283
5,645,216 A 7/1997 Benenowski et al.
6,027,034 A * 2/2000 Demmig et al. ..... 238/382

FOREIGN PATENT DOCUMENTS

| | | |
|---|---|---|
| DE | 4011013 | 6/1991 |
| DE | 89158377 | 10/1991 |
| DE | 4138575 | 5/1993 |
| DE | 4314578 | 11/1994 |
| EP | 0632164 | 1/1995 |
| WO | 95/06165 | 3/1995 |

* cited by examiner

*Primary Examiner*—Mark T. Le
(74) *Attorney, Agent, or Firm*—Dennison, Schultz & Dougherty

(57) ABSTRACT

A superstructure arrangement for a track comprising a rail fastened to a securing device such as a ribbed plate which is disposed above a concrete sleeper, with an intermediate layer extending between the sleeper and the securing device. The rigidity of the intermediate layer is variable and rated so that at the maximum permissible stress in the rail, caused by bending under wheel lead, the elastic property changes to substantially non-elastic.

17 Claims, 5 Drawing Sheets

SUPERSTRUCTURE CONSTRUCTION

The present application is a continuation of application Ser. No. 09/051,476 filed Aug. 11, 1998, now U.S. Pat. No. 6,027,034, which is a 371 PCT/EP96/04536 filed Oct. 18, 1996.

BACKGROUND OF THE INVENTION

The invention relates to a superstructure construction comprising a rail disposed above a support layer such as a concrete sleeper and in its turn extending from a securing device such as a ribbed plate, where at least one intermediate layer with a rigidity x is disposed between the support layer and the securing device.

Bedding sleepers on ballast or resorting to designs with a ballastless track and stable, rigid sleeper mountings are known. In the latter case, the sleeper such as a concrete sleeper is placed on asphalt or concrete supporting plates or suitable troughs and then partially cast in place using a sealing compound such as concrete or asphalt.

To achieve a reduction of the structure-borne and airborne sound emitted by a rail in ballastless tracks, a construction is known where a standard rail such as S54 is placed on a cork layer inside a channel comprising concrete or steel parts. In addition, cavities are provided that are filled at the top with a polyurethane/cork mixture to reduce sound.

However, this construction has not brought the desired result, and indeed sound measurements show that there has even been a 10 dB sound increase compared with the ballast construction.

A device for mounting rails for rolling stock is known from DE 89 15 837 U1, in which a ribbed plate is disposed on an elastic intermediate layer whose thickness is at least that of the ribbed plate. The intermediate layer can here have a required elasticity thanks to certain geometrical parameters. The same applies for DE 40 11 013 A1, which relates to a tempered rail structure for high-speed tracks. It is intended here to ensure, by providing a cavity with plastic-modified adhesive mortar, that a direct transmission of heat energy or cooling energy to the rail is prevented.

According to DE 41 38 575 A1, the spring rigidity of an elastic intermediate layer can be designed dependent on the contact force.

EP 0 632 164 A1 contains the proposal to structure the bottom of an elastic intermediate layer such that under load a higher rigidity results, while the transmission of sound is to be restricted at the same time.

An elastic rail support layer with bottom compression points and all-round closed edge strip is known from DE 43 14 578 A1.

The problem underlying the present invention is to develop a superstructure construction, in particular one on a ballastless track, such that a reduction of structure-borne and airborne sound is achieved.

The problem is substantially solved in accordance with the invention in that the rigidity x of the intermediate layer is rated such that at the maximum permissible and/or presettable rail stress in the rail the intermediate layer has substantially non-elastic properties such that further bending of the rail only takes place insubstantially if at all.

In accordance with the invention, the intermediate layer is rated for the permissible or required maximum rail stress, which has the advantage that the rail itself is on a softer support, thus achieving a decoupling between the rail and the sleeper. The effect of this is a lower loading of the support point and in turn a reduction in the structure-borne sound. This can be improved by using as rails those with high moment of inertia and moment of resistance when seen over the rail central axis, for example a filled section rail, so that the rail can perform the function of a support and develop a load-bearing effect. This results in a further decoupling between rail and sleeper, whereby a further reduction is achieved of the structure-borne sound emitted by the rail when it is traversed by rolling stock.

An intermediate layer is proposed that has a low rigidity before the maximum permissible and/or presettable rail stress is reached and a high rigidity when this rail stress is reached.

It is preferably provided here that the intermediate layer has a rigidity x of $x \leqq 25$ kN/mm, preferably $4 \leqq x \leqq 25$ kN/mm, and/or that at the maximum permissible rail stress the intermediate layer has a rigidity x of $x \geqq 35$ kN/mm, in particular $x \geqq 90$ kN/mm, preferably in the vicinity of 100 kN/mm.

SUMMARY OF THE INVENTION

In accordance with the invention, it is proposed that when the intermediate layer is without load it has projections extending beyond its underside and is surrounded within the intermediate layer by a cavity (recess) on the circumferential side. The cavity has a volume $V_a$, which is equal to a volume $V_b$ that the respective projection has in its section projecting beyond the underside.

Thanks to the structure in accordance with the invention, the projections have the function of a supporting spring which is effective when the maximum rail stress of the rail supported by the support layer has not yet been reached. If this is then reached, the projections are forced into the support layer such that the projections are flush with the underside of the intermediate layer and at the same time fill the entire cavities (recesses). As a result, the form factor of the intermediate layer is increased such that the maximum permissible rail stress is not generally exceeded even when further forces are introduced. The intermediate layer should have a rigidity x which is in the vicinity of 100 kN/mm in particular when the cavities in the support layer are completely filled by the material of the projections.

It is provided in particular that the rail is a Vignol rail with a maximum permissible rail stress of 70 to 100 N/mm$^2$ and that the intermediate layer has a rigidity x of approximately 4 to 16 kN/mm, provided the maximum permissible rail stress has not yet been reached.

Apart from the geometry of the rail, an embodiment of the invention provides that in particular rails are used that have a moment of inertia $I_x$ with preferably $I_x \geqq 3400$ cm$^4$ and a moment of resistance $W_x$ with preferably $W_x \geqq 350$ cm$^3$.

In particular, a superstructure construction with ballastless track is provided in which the rail is a filled section rail with a moment of inertia $I_x$ of $3700 \leqq I_x \leqq 3800$ cm$^4$ and a moment of resistance $W_x$ of $390 \leqq W_x \leqq 410$ cm$^3$ and a maximum required rail stress $\sigma$ can be generated (approx. 70±4 N/mm$^2$ for rail steel UIC Class A with 880 N/mm$^2$ tensile strength) and the intermediate layer has a rigidity x of approximately 10±2 kN/mm for filled section tracks. In the case of traffic carriers with low axle loads, rigidities lower than the previously stated value are obtained.

In an embodiment of the invention, the arrangement provides for the rail to be designed at its foot such that the latter emits sound waves with a frequency v when vibrations are excited, said waves being substantially outside a frequency range between 500 and 3000 Hz. This results in a rail foot design in respect of its vibration technology that ensures a considerable reduction of the airborne sound.

In addition, the rail can be designed without a web, which also prevents problems from unwelcome airborne sound.

If the rail has a web, the latter should be designed such that it emits sound waves with a frequency v when vibrations are excited, said waves being substantially outside a frequency range between approximately 500 and 3000 Hz.

To ensure that the rail cannot tilt due to the fact that it rests on a relatively soft intermediate layer with its securing device, an embodiment of the invention provides that the rail forms together with the securing device such as a ribbed plate a unit which has the effect of widening the rail. The securing device here can be positioned inside the intermediate layer and enclosed by the latter along its longitudinal edge.

Further details, advantages and features of the invention are shown not only in the claims and in the features they contain—singly and/or in combination—but also in the following description of preferred design examples shown in the drawing.

DETAILED DESCRIPTION OF THE INVENTION

Figure 1:
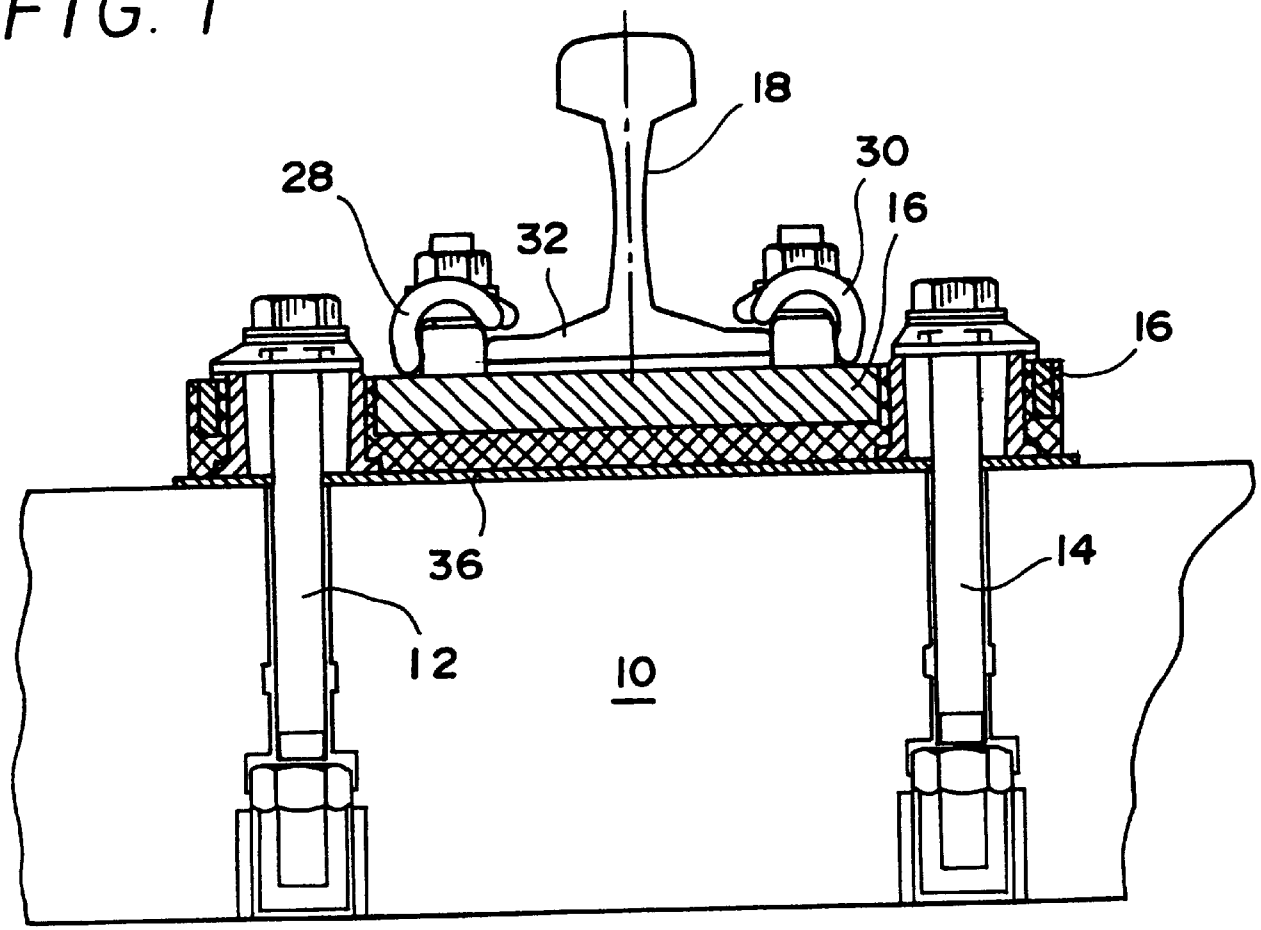
FIG. 1 a section through a superstructure construction with a first embodiment of a Vignol rail, FIG. 2 a section through a superstructure construction with a second embodiment of a Vignol rail, FIG. 3 a section through a superstructure construction with a filled section rail, FIG. 4 a section through an intermediate layer with low effective rigidity, FIG. 5 the intermediate layer according to FIG. 4 with high effective rigidity, and, FIG. 6 a characteristic.
Figure 2:
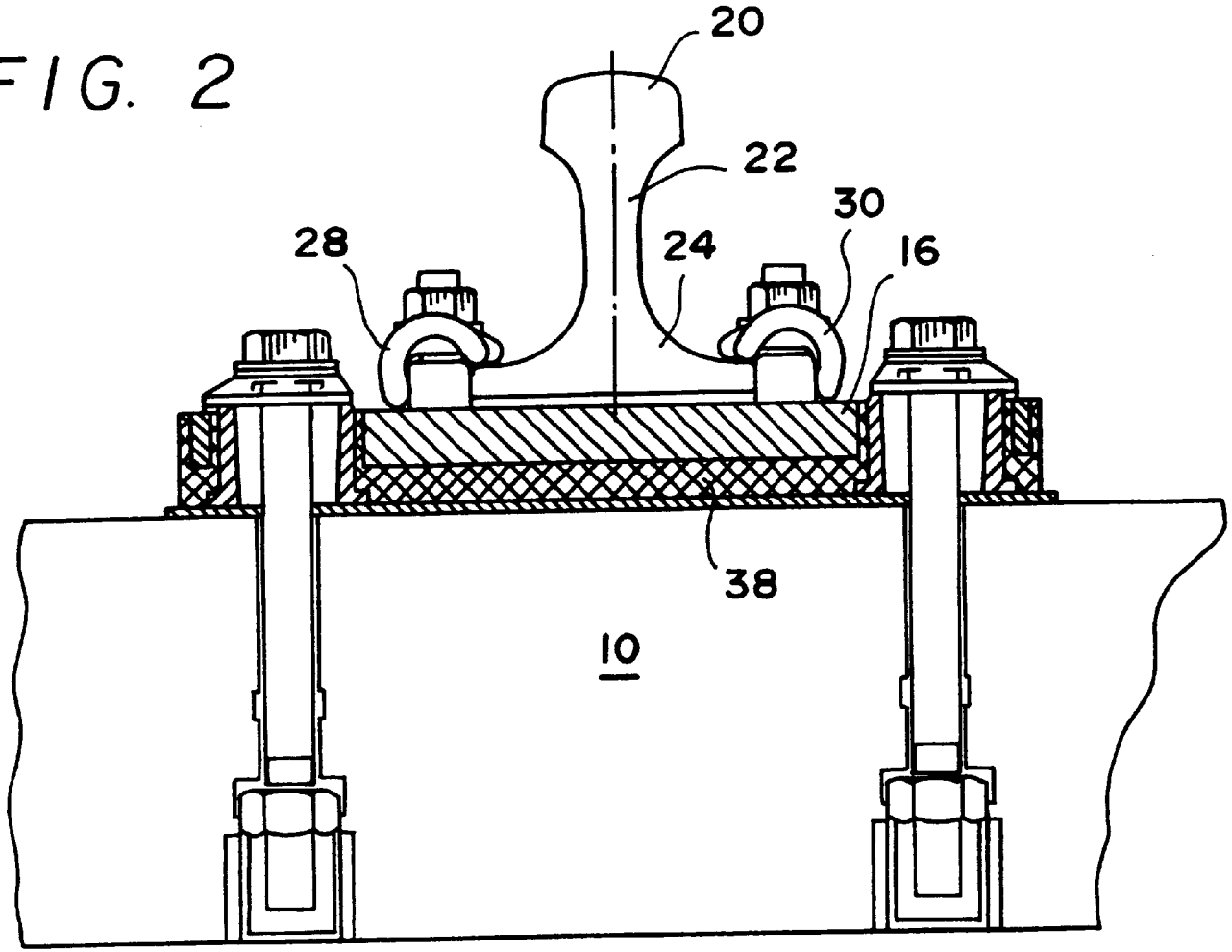
Figure 3:
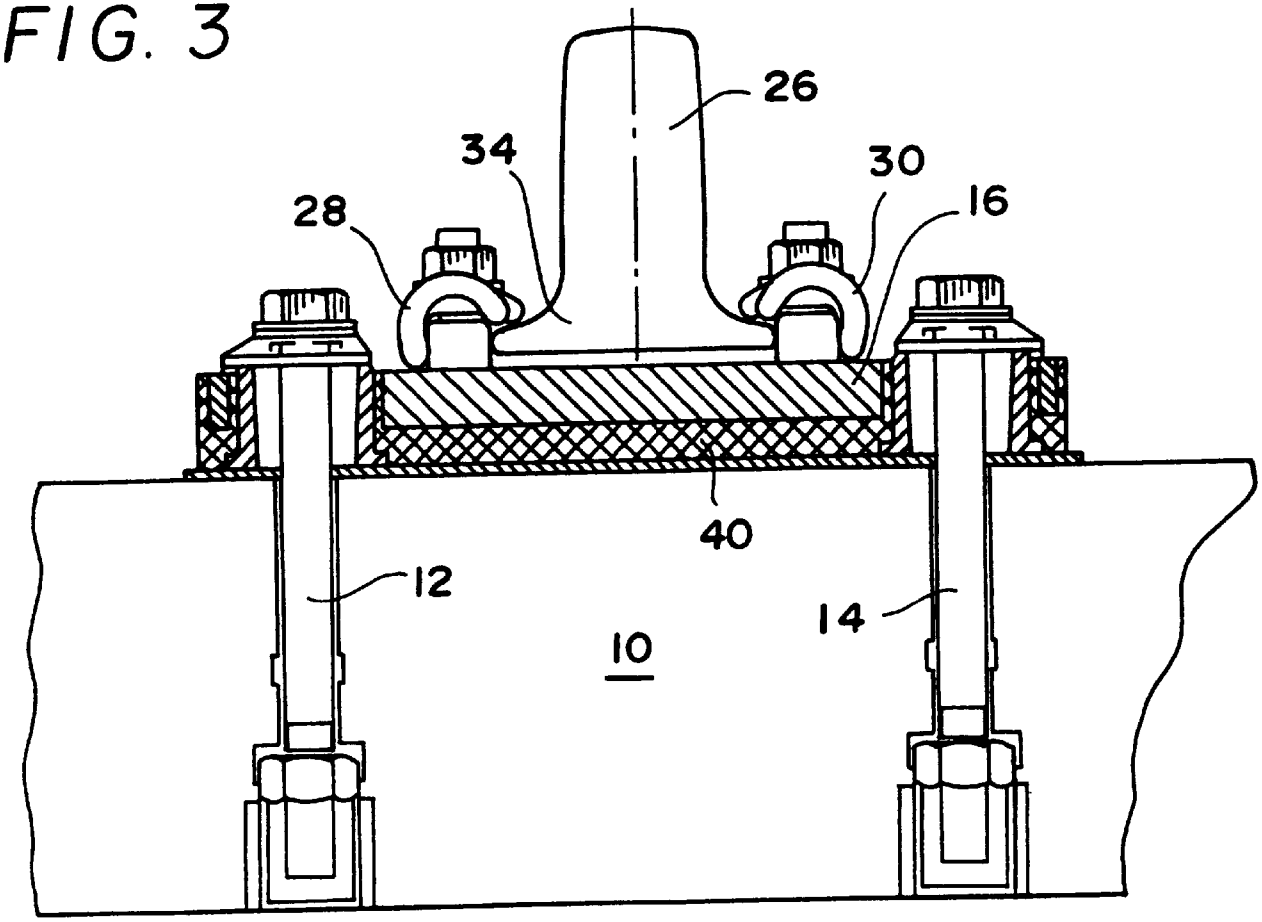

The figures—where as a general rule identical elements are identified by identical reference numbers—show sections through a ballastless track comprising a concrete sleeper 10, a ribbed plate 16 connected thereto by bolts 12, 14, and a rail attached to this ribbed plate, the rails being a UIC60 rail 18 in FIG. 1, a Vignol rail 20 in FIG. 2, which has a changed vibration technology compared with the UIC60 rail 18 in respect of the web 22 and the foot 24, and a filled section rail 26 in FIG. 3.

The respective rails 18, 20, 26 are secured to the ribbed plate 16 using suitable fasteners such as clips 28, 30 resting on the feet 24 or 32, 34 of the rails 20 or 18 and 26 respectively. Here the connection between the fasteners 28 and 30 and the respective rail feet 24, 32, 34 is such that a mechanical unit is formed that leads to an apparent widening of the rail foot. As a result, the respective rail 18, 20, 26 attains a greater tilting stability.

As regards the fastening of the ribbed plate 16 to the concrete sleeper 10 using the bolts 12 and 14, reference is made to standard designs, in particular however to those found in WO 95/17552.

Regardless of the type of fastening between the ribbed plate 16 or element with the same effect and the sleeper 10, however, it is provided in accordance with the invention that an elastic intermediate layer 36, 38, 40 passes between the ribbed plate 16 or corresponding securing device for the rail 18, 20, 26 respectively and the sleeper 10, said intermediate layer having a rigidity x that depends on the maximum required rail stress of the respective rail 18, 20, 26. In this case the ribbed plate 16 is preferably vulcanized into the intermediate layer 36, 38, 40, which in turn has a so-called kinked rigidity characteristic. This means that the intermediate layer 36, 38, 40 has properties which are soft in that working range in which the rail 18, 20, 26 has not yet reached the maximum permissible rail stress, but then abruptly become hard when the maximum permissible rail stress prevails. To obtain a so-called kinked characteristic, design measures to be found in WO 94/08093 can be selected.

Figure 4:
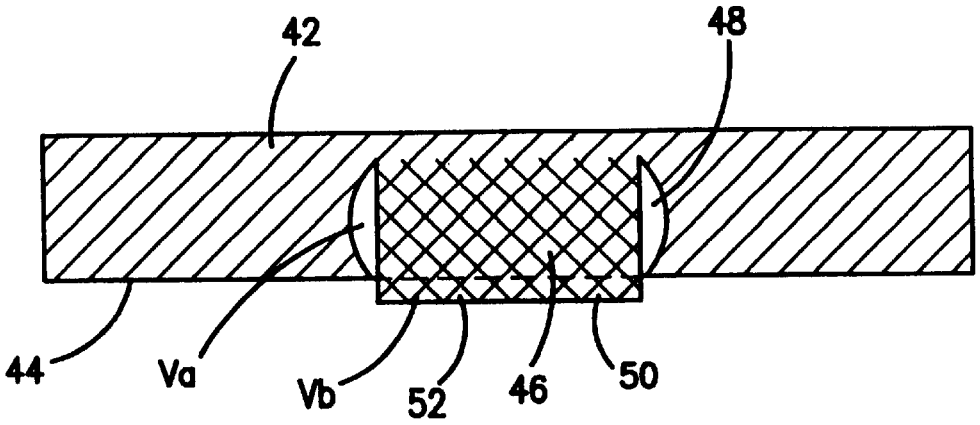
Figure 5:
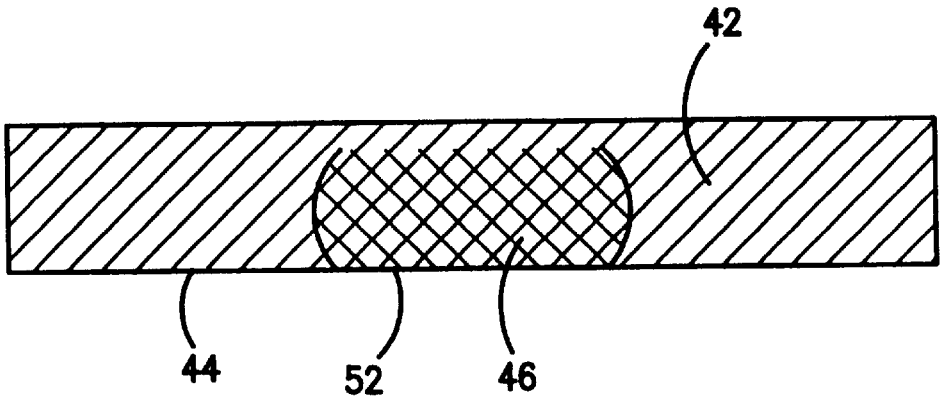

In particular however, the measures to be found in FIGS. 4 and 5 must be provided, in order to set the rigidity of the intermediate layer such that its properties are soft before the maximum permissible rail stress is reached, and then change abruptly to hard properties when the maximum permissible rail stress prevails.

An intermediate layer 36, 38, 40 shown in FIGS. 1 to 3 can in its principle have a design as shown in FIGS. 4 and 5 and provided with the reference number 42. The intermediate layer 42 therefore has projections 46 projecting beyond its underside 44. At the same time, the projections 46 are surrounded by a cavity 48 (recess in the intermediate layer 42) when the intermediate layer 42 is without load. This cavity 48 has a volume $V_a$ corresponding to the volume $V_b$ of that section 50 of the projections 46 which extends beyond the underside 44 of the intermediate layer 42.

The projections 46 perform, under standard loading of the rail, i.e. before the maximum permissible rail stress is attained, supporting spring functions, and accordingly support the ribbed plate 16 alone. As the force introduced increases and, concomitantly, the rail stress likewise increases, the projection 46 is forced more and more into the intermediate layer 42, the result being that the cavity 48 is filled by the material of the projection 46. When the maximum permissible rail stress is reached, the projection 46 fills the entire cavity 48, so that as a consequence thereof the front face 52 of the projection 46 is flush with the underside 44 of the intermediate layer 42. Because of this, the entire intermediate layer 42 performs supporting functions, with the result that the intermediate layer as a whole is effective with a high rigidity. This in turn means that when further forces are introduced into the rail its rail stress can only be increased insubstantially, if at all.

FIG. 5 shows the intermediate layer 42 with the projections 46 forced into it. It can be seen that the front faces 52 of the projections are aligned with the underside 44 of the intermediate layer 42.

Figure 6:
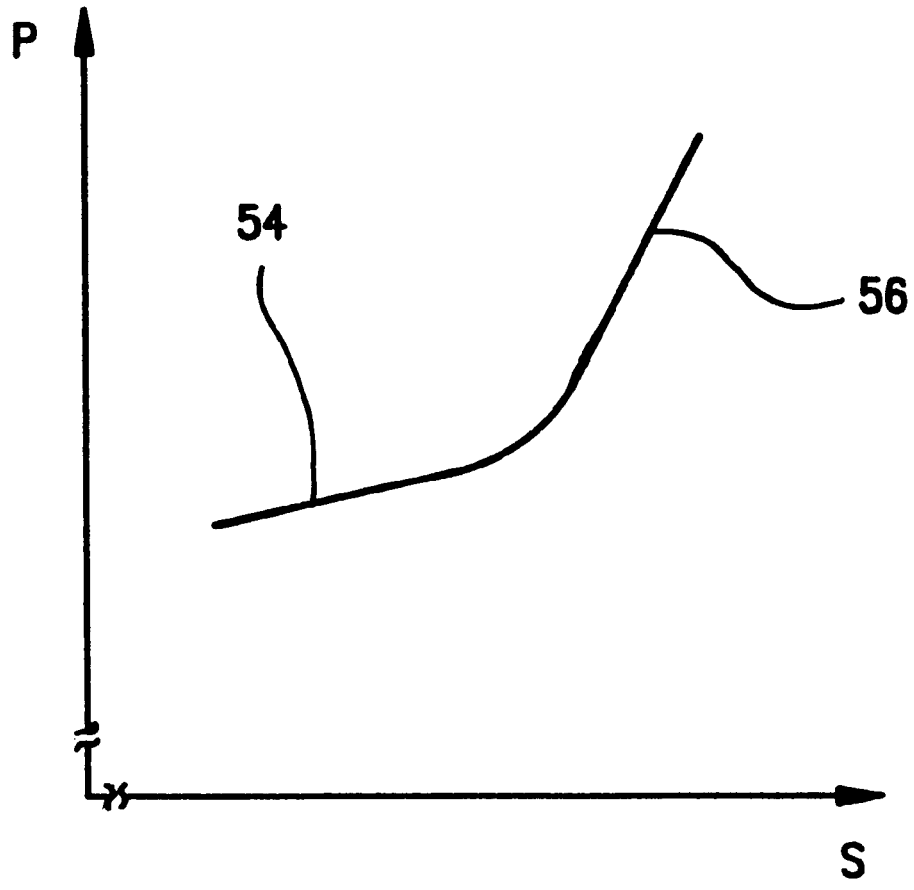

FIG. 6 shows purely in principle the characteristic of the intermediate layer 42. The subsidence s is therefore shown as a function of the force acting on the intermediate layer 42. In the area in which the maximum permissible rail stress has not yet been reached the characteristic has a flat curve, which rises steeply when the maximum permissible rail stress has been reached.

In other words, the intermediate layer 42 is designed such that the rail is bendable enough that the maximum permissible rail stress can be generated and when the latter is reached no further bending is possible, since the intermediate layer 42 has a high rigidity x which is preferably in the vicinity of 100 kN/mm or more.

The maximum permissible rail stress is that rail stress which can occur at the foot underside and can be ascertained using a measuring strip, for example. It is provided here for ballastless tracks that the maximum required rail stress is 70±4 N/mm$^2$ with a standard wheel load of 10 t in rolling stock traversing the rail.

To permit an appropriate maximum rail stress when rolling stock with a wheel load of 10 t traverses the rail, the rigidity x of the respective intermediate layer 36, 38, 40 is rated accordingly, i.e. the rigidity x of the intermediate layer 36, 38, 40 compared with known superstructure constructions is reduced, meaning that the rail 18, 20, 26 can have a softer support. This in turn results in a reduction of the structure-borne sound since the rail 18, 20, 26 is decoupled from the sleeper 10. The support point load is reduced too.

To realize the teachings in accordance with the invention, however, it is provided that the intermediate layer 36, 38, 40 has in respect of its spring properties or rigidity a so-called kinked characteristic. The intermediate layer 36, 38, 40 therefore has elastic or "soft" properties as long as the maximum permissible or presettable rail stress has not yet been reached. If this rail stress does prevail, the intermediate layer 36, 38, 40 is "hard", i.e. has a high rigidity, so that there is no further bending of the rail 18, 20, 26 and hence no increase in the rail stress.

Since a rail can, depending on its geometry, more or less perform the function of a support and hence develop a load-carrying effect, a reduction of the rigidity x of the intermediate layer results when the moment of inertia $I_x$ and the moment of resistance $W_x$ of the rail are increased, i.e. for example when the geometry of a standard UIC60 rail 18 is altered to the effect that the web 22 is widened and the rail foot 24 merges with a slight curvature into the web 22 in accordance with FIG. 2. The result of this is that the rail 20 can be mounted more softly without exceeding the maximum permissible rail stress of 70±4 N/mm$^2$ in particular. Soft mounting means however a further decoupling from the sleeper 10, with the consequence that the structure-borne sound emitted by the rail 20 is reduced.

Even better results are obtained with the filled section rail 26 according to FIG. 3, since the even higher moment of inertia $I_x$ and moment of resistance $W_x$ permit an even softer mounting before the maximum permissible rail stress is attained.

The geometry of the rail 20 or that of the filled section rail 26 furthermore has the advantage that the foot 24 or 34 respectively has been changed in its vibration technology compared with the UIC60 rail 18, such that when vibrations are excited the emitted sound is not in the undesirable frequency range between 500 and 3000 Hz. The widening or shape alteration of the web 22 of the rail 20 also reduces the airborne sound usually emitted by the web of a Vignol rail.

On the basis of the teachings in accordance with the invention, that the rail 18, 20, 26 is elastically mounted on the intermediate layer 36, 38, 40 such that under normal wheel loads the maximum permissible rail stress can be reached, but—thanks to the kinked curve of the characteristic—is not generally exceeded, the advantage is obtained that the rail 18, 20, 26 and the sleeper 10 are decoupled such that undesirable structure-borne sound is prevented. If in addition a filled section rail 26 or a Vignol rail 20 with web 22 of modified vibration characteristics and foot 24 is used in order to largely suppress the emission of airborne sound in the range between 500 and 3000 Hz, the result is an improvement of the ballastless track from the acoustic viewpoint.

Taking into account the teachings in accordance with the invention, the result for a filled section rail Vo 1–60 with $I_x$=3760 cm$^4$, $W_x$=430 cm$^3$ and a maximum permissible rail stress of 73 N/mm$^2$ for the intermediate layer 40 is a rigidity of 10 kN/mm, from which in turn a maximum support point load of 25.3 kN is calculated. These values apply in that working range in which the maximum rail stress is not exceeded. If by contrast the latter is reached, the rigidity of the intermediate layer 40 changes such that the latter is "hard", i.e. largely non-elastic, so that there is no further bending of the rail. In this "hard" range the rigidity x should be ≧35 kN/mm.

These values show that the filled section rail 26 is decoupled from the support layer 40 to an extent that when it is traversed by rolling stock the structure-borne sound of the rail 26 is only transmitted to a minor extent to the sleeper 10 and hence to the substructure.

We claim:

1. A superstructure arrangement for a track comprising:

a rail (18, 20, 26) fastened to a securing device (16) which is disposed above a sleeper (10) and at least one intermediate layer (36, 38, 40) extending between the sleeper and the securing device, the rail having a maximum permissible stress;

wherein the intermediate layer has a rigidity x such that at the maximum permissible stress in the rail by bending generated in response to wheel load, the intermediate layer has a substantially non-elastic property, so that further bending of the rail under additional load causes only insubstantial additional stress in said rail.

2. The superstructure arrangement according to claim 1, wherein the intermediate layer has a rigidity x of x≦25 kN/mm.

3. The superstructure arrangement according to claim 1, wherein at the maximum permissible rail stress, the intermediate layer has a rigidity x of x≧35 kN/mm.

4. The superstructure arrangement according to claim 1, wherein the rail is a Vignol rail (20) with a maximum permissible rail stress of 70 to 100 N/mm$^2$ and wherein the intermediate layer (38) has a rigidity x of 4 to 16 kN/mm before the maximum permissible rail stress is reached.

5. The superstructure arrangement according to claim 1, wherein the rail is a filled section rail (26), comprising with approximately 880 N/mm$^2$ tensile strength with a moment of inertia $I_x$ of $I_x$≧3700 cm$^4$ and/or a moment of resistance $W_x$ of $W_x$≧390 cm$^3$, and wherein at a maximum required rail stress of 70±4 N/mm$^2$, the intermediate layer (40) has a rigidity x of 10±2 kN/mm.

6. The superstructure arrangement according to claim 1, wherein the foot of the rail (20) emits sound waves with a frequency v when vibrations are excited, said waves being substantially outside a frequency range between 500 and 3000 Hz.

7. The superstructure arrangement according to claim 1, wherein the rail (26) is designed without a web.

8. The superstructure arrangement according to claim 1, wherein the rail (20) is designed at its web such that the web (22) emits sound waves with a frequency v when vibrations are excited, said waves being substantially outside a frequency range between 500 and 3000 Hz.

9. The superstructure arrangement according to claim 1, wherein the rail (18, 20, 26) forms with the securing device (16) a unit effecting a widening of a rail foot.

10. The superstructure arrangement according to claim 1, wherein the intermediate layer is positioned inside the securing device and enclosed by said securing device.

11. The superstructure arrangement according to claim 1, wherein the rigidity x of the intermediate layer is rated such that the rail is deformable up to a rail stress in the range from 70 to 100 N/mm$^2$.

12. The superstructure arrangement according to claim 1 wherein the intermediate layer has a rigidity x in the range of 4≦×≧25 kN/mm.

13. The superstructure arrangement according to claim 1, wherein at the maximum permissible rail stress, the intermediate layer has a rigidity x such that $x \geqq 90$ kN/mm.

14. The superstructure arrangement according to claim 1, wherein at the maximum permissible rail stress, the intermediate layer has a rigidity x such that x is equal to about 100 kN/mm.

15. The superstructure arrangement according to claim 1, wherein the rail is a filled section rail (26) with approximately 880 $N/mm^2$ tensile strength with a moment of inertia $I_x$ of $I_x \geqq 3700$ $cm^4$ and/or a moment of resistance $W_x$ of $W_x \geqq 390$ $cm^3$, and wherein at a maximum required rail stress of $70 \pm 4$ $N/mm^2$, the intermediate layer (40) has a rigidity x of $10 \pm 2$ kN/mm.

16. A superstructure arrangement for a track comprising:

a sleeper;

a securing device fastened to said sleeper;

a rail fastened to said securing device and having a maximum stress level; and an intermediate layer mounted between said securing device and said sleeper, said intermediate layer being elastic in response to forces up to a first amount and being rigid in response to forces greater than said first amount wherein said first amount is equal to about said maximum stress level.

17. A superstructure arrangement for a track comprising:

a sleeper;

a securing device fastened to said sleeper;

a rail fastened to said securing device and having a maximum stress level; and decoupling means mounted between said securing device and said sleeper for substantially decoupling said rail from said sleeper while substantially preventing stress in said rail from exceeding said maximum stress level.

* * * * *

UNITED STATES PATENT AND TRADEMARK OFFICE

CERTIFICATE OF CORRECTION

PATENT NO. : 6,409,092 B1
DATED : June 25, 2002
INVENTOR(S) : Demmig et al.

It is certified that error appears in the above-identified patent and that said Letters Patent is hereby corrected as shown below:

Title page,
Item [*] Notice, delete "0" and insert -- 112 --.

Signed and Sealed this

Thirtieth Day of August, 2005

JON W. DUDAS
*Director of the United States Patent and Trademark Office*